US010099486B2

(12) United States Patent
Andou et al.

(10) Patent No.: US 10,099,486 B2
(45) Date of Patent: Oct. 16, 2018

(54) THERMAL HEAD AND THERMAL PRINTER

(71) Applicant: KYOCERA Corporation, Kyoto-shi, Kyoto (JP)

(72) Inventors: Tsuyoshi Andou, Kirishima (JP); Kouji Ochi, Kirishima (JP); Hiroshi Masutani, Yokohama (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/523,211

(22) PCT Filed: Oct. 30, 2015

(86) PCT No.: PCT/JP2015/080795

§ 371 (c)(1),
(2) Date: Apr. 28, 2017

(87) PCT Pub. No.: WO2016/068313

PCT Pub. Date: May 6, 2016

(65) Prior Publication Data

US 2017/0320334 A1 Nov. 9, 2017

(30) Foreign Application Priority Data

Oct. 30, 2014 (JP) ..... 2014-221559

(51) Int. Cl.
*B41J 2/335* (2006.01)
*B41J 2/345* (2006.01)

(52) U.S. Cl.
CPC ..... *B41J 2/335* (2013.01); *B41J 2/3351* (2013.01); *B41J 2/3352* (2013.01); *B41J 2/3353* (2013.01);
(Continued)

(58) Field of Classification Search
CPC ..... B41J 2/335; B41J 2/3351; B41J 2/3353; B41J 2/33595; B41J 2/3355;
(Continued)

(56) References Cited

U.S. PATENT DOCUMENTS

2013/0328988 A1* 12/2013 Moto ..... B41J 2/335
347/188

FOREIGN PATENT DOCUMENTS

JP 08-207332 * 8/1996 ..... B41J 2/335
JP H08-207332 A 8/1996
(Continued)

OTHER PUBLICATIONS

International Search Report (Form PCT/ISA/210) dated Jan. 19, 2016, issued for PCT/JP2015/080795.
(Continued)

*Primary Examiner* — Yaovi M Ameh
(74) *Attorney, Agent, or Firm* — Volpe and Koenig, P.C.

(57) ABSTRACT

A thermal head includes a substrate; a plurality of heat generating portions; a common electrode disposed on the substrate and electrically connected to the plurality of heat generating portions; a plurality of individual electrodes disposed on the substrate and each electrically connected to a corresponding one of the plurality of heat generating portions; a first insulation layer disposed on the heat generating portions, a part of the common electrode, and a part of the individual electrodes; a second insulation layer located adjacent to the first insulation layer and disposed on a part of the individual electrodes; and a static removing layer disposed on the first insulation layer and grounded. The static removing layer includes a first portion disposed on an upper surface of the first insulation layer and a second portion electrically connected to the first portion and disposed on an upper surface of the second insulation layer.

15 Claims, 9 Drawing Sheets

(52) U.S. Cl.
CPC ..... *B41J 2/3354* (2013.01); *B41J 2/3357* (2013.01); *B41J 2/33515* (2013.01); *B41J 2/33525* (2013.01); *B41J 2/33535* (2013.01); *B41J 2/33545* (2013.01); *B41J 2/33595* (2013.01); *B41J 2/345* (2013.01); *B41J 2/3355* (2013.01); *B41J 2/33565* (2013.01)

(58) Field of Classification Search
CPC B41J 2/33565; B41J 2/33515; B41J 2/33545; B41J 2/3354; B41J 2/33535; B41J 2/33525; B41J 2/345; B41J 2/3357; B41J 2/3352
See application file for complete search history.

(56) References Cited

FOREIGN PATENT DOCUMENTS

| | | | |
|---|---|---|---|
| JP | 2005-178003 | A | 7/2005 |
| JP | 2010-214919 | A | 9/2010 |

OTHER PUBLICATIONS

Written Opinion (Form PCT/ISA/237) dated Jan. 19, 2016, issued for PCT/JP2015/080795.

* cited by examiner

THERMAL HEAD AND THERMAL PRINTER

TECHNICAL FIELD

The present invention relates to a thermal head and a thermal printer.

BACKGROUND ART

To date, various thermal heads have been proposed for use as a printing device of fax machines, video printers, or the like. For example, a known thermal head includes a support substrate; a plurality of heat generating portions disposed on the support substrate; a common electrode portion disposed on the support substrate and electrically connected to the plurality of heat generating portions; individual electrode lead portions disposed on the support substrate and each electrically connected to a corresponding one of the plurality of heat generating portions; a first insulation layer disposed on the heat generating portions, the common electrode portion, and the individual electrode lead portions; a second insulation layer located adjacent to the first insulation layer and disposed on the individual electrode lead portions; and a static removing layer disposed on the first insulation layer (see PTL 1). The static removing layer has a function of removing static electricity accumulated on a recording medium. Therefore, the thermal head has a static removing function of removing static electricity accumulated on a recording medium.

CITATION LIST

Patent Literature

PTL 1: Japanese Unexamined Patent Application Publication No. 2005-178003

SUMMARY OF INVENTION

Technical Problem

However, the static removing function of the static removing layer of the thermal head described in PTL 1 is still insufficient.

Solution to Problem

A thermal head according to an embodiment of the present invention includes a substrate; a plurality of heat generating portions disposed on the substrate; a common electrode disposed on the substrate and electrically connected to the plurality of heat generating portions; a plurality of individual electrodes disposed on the substrate and each electrically connected to a corresponding one of the plurality of heat generating portions; a first insulation layer disposed on the heat generating portions, the common electrode, and the individual electrodes; a second insulation layer located adjacent to the first insulation layer and disposed on the individual electrodes; and a static removing layer that is grounded. The static removing layer comprises a first portion disposed on an upper surface of the first insulation layer and a second portion electrically connected to the first portion and disposed on an upper surface of the second insulation layer.

A thermal printer according to an embodiment of the present invention includes one of the thermal heads described above, a conveying mechanism that conveys a recording medium onto the heat generating portions, and a platen roller that presses the recording medium against the heat generating portions.

Advantageous Effects of Invention

With the present invention, the static removing function of the static removing layer can be enhanced.

DESCRIPTION OF EMBODIMENTS

First Embodiment

Figure 1:
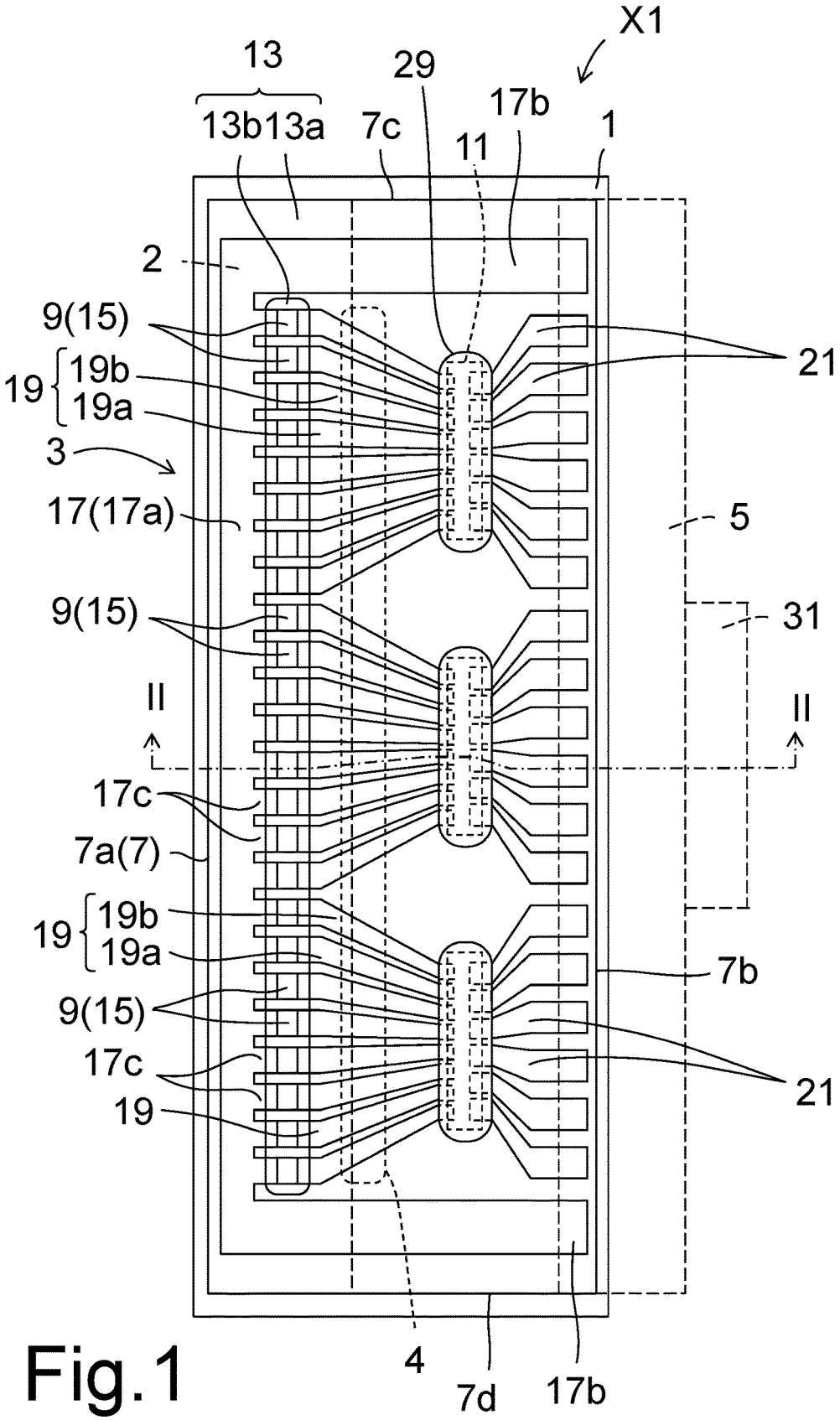
FIG. 1 is a schematic plan view of a thermal head according to a first embodiment of the present invention.

Hereinafter, a thermal head X1 will be described with reference to FIGS. 1 to 6. The thermal head X1 includes a heat sink 1, a head base body 3 disposed on the heat sink 1, a flexible printed circuit 5 (hereinafter, referred to as "FPC 5") connected to the head base body 3, and a connector 31 electrically connected to the FPC 5. In FIG. 1, the FPC 5 and the connector 31 are not illustrated, and regions in which the FPC 5 and the connector 31 are disposed are represented by broken lines. In FIG. 1, a static removing layer 2 is not illustrated and is represented by a long chain line. A first insulation layer, a second insulation layer, and a covering layer are not illustrated. In FIG. 3, connection portions 2*c* are represented by diagonal hatching.

The heat sink 1 has a plate-like shape that is rectangular in a plan view. The heat sink 1 is made of, for example, a metal material, such as copper, iron, or aluminum. The heat sink 1 has a function of dissipating a part of heat that is generated by heat generating portions 9 of the head base body 3 and that does not contribute to printing. The head base body 3 is bonded to the upper surface of the heat sink 1 by using a double-sided tape, an adhesive, or the like (not shown).

The head base body 3 has a plate-like shape in a plan view, and components of the thermal head X1 are disposed on a substrate 7. The head base body 3 has a function of performing printing on a recording medium (not shown) in accordance with an electrical signal supplied from the outside.

The FPC 5 is electrically connected to the head base body 3 and includes an insulating resin layer and a plurality of printed wires patterned in the insulating resin layer. The FPC 5 is a circuit board having a function of supplying an electric current and an electrical signal to the head base body 3. One end of each of the printed wires is exposed from the resin layer, and the other end of each of the printed wires is electrically connected to the connector 31.

The printed wires of the FPC 5 are connected to connection electrodes 21 of the head base body 3 via a joining material 23. Thus, the head base body 3 and the FPC 5 are electrically connected to each other. Examples of the joining material 23 include a solder and an anisotropic conductive film (ACF), which is composed of an electrically insulating resin and electrically conductive particles mixed in the resin. The head base body 3 and the FPCS may be directly connected to each other without using the joining material 23.

In the example described above, the FPC 5 is used as a circuit board. Instead the FPC 5, which is flexible, a hard circuit board may be used. Examples of a hard circuit board include a glass epoxy substrate and a substrate made of a resin, such as a polyimide substrate. The connector 31 may be directly connected to the head base body 3 without using the FPC 5.

Hereinafter, components of the head base body 3 will be described

The substrate 7 has a rectangular shape in a plan view. The substrate 7 is made of an electrically insulating material such as alumina ceramic, a semiconductor material such as single-crystal silicon, or the like. The substrate 7 includes one long side 7*a*, the other long side 7*b*, one short side 7*c*, and the other short side 7*d*.

A heat storage layer 13 is disposed on the upper surface of the substrate 7. The heat storage layer 13 includes an underlying portion 13*a* and a protruding portion 13*b*. The underlying portion 13*a* extends over the entire area of the upper surface of the substrate 7. The protruding portion 13*b* extends in a strip-like shape in the main scanning direction and has a substantially semi-elliptical cross section. The protruding portion 13*b* functions to appropriately press a recording medium, on which printing is to be performed, against a first insulation layer 25 disposed on the heat generating portions 9.

The heat storage layer 13 is made of glass having low thermal conductivity and temporarily stores a part of heat generated by the heat generating portions 9. Therefore, the heat storage layer 13 can reduce the time required to increase the temperature of the heat generating portions 9, and functions to increase the thermal responsivity of the thermal head X1. The heat storage layer 13 is formed, for example, by applying a predetermined glass paste, which is obtained by mixing glass powder with an appropriate organic solvent, to the upper surface of the substrate 7 by using a known method, such as screen printing; and by firing the glass paste.

An electrically resistive layer 15 is disposed on the upper surface of the heat storage layer 13. A common electrode 17, individual electrodes 19, and the connection electrodes 21 are disposed on the electrically resistive layer 15. The electrically resistive layer 15 is patterned in the same shape as the common electrode 17, the individual electrodes 19, and the connection electrodes 21. The electrically resistive layer 15 has exposed regions, in which the electrically resistive layer 15 is exposed, between the common electrode 17 and the individual electrodes 19. As illustrated in FIG. 1, the exposed regions of the electrically resistive layer 15 are arranged in a row on the protruding portion 13*b* of the heat storage layer 13, and the exposed regions serve as the heat generating portions 9.

The plurality of heat generating portions 9, which is illustrated in a simplified manner in FIG. 1 for convenience of description, is disposed at a density of, for example, 100 dpi to 2400 dpi (dot per inch). The electrically resistive layer 15 is made of, for example, a material having relatively high electric resistance, such as a TaN-based, TaSiO-based, TaSiNO-based, TiSiO-based, TiSiCO-based, or NbSiO-based material. Therefore, when a voltage is applied to the heat generating portions 9, the heat generating portions 9 generate heat by Joule heating.

The electrically resistive layer 15 need not be patterned in the same shape as the common electrode 17, the individual electrodes 19, and the connection electrodes 21. The electrically resistive layer 15 may be disposed only between the common electrode 17 and the individual electrodes 19 so as to electrically connect the common electrode 17 and the individual electrodes 19 to each other.

Figure 2:
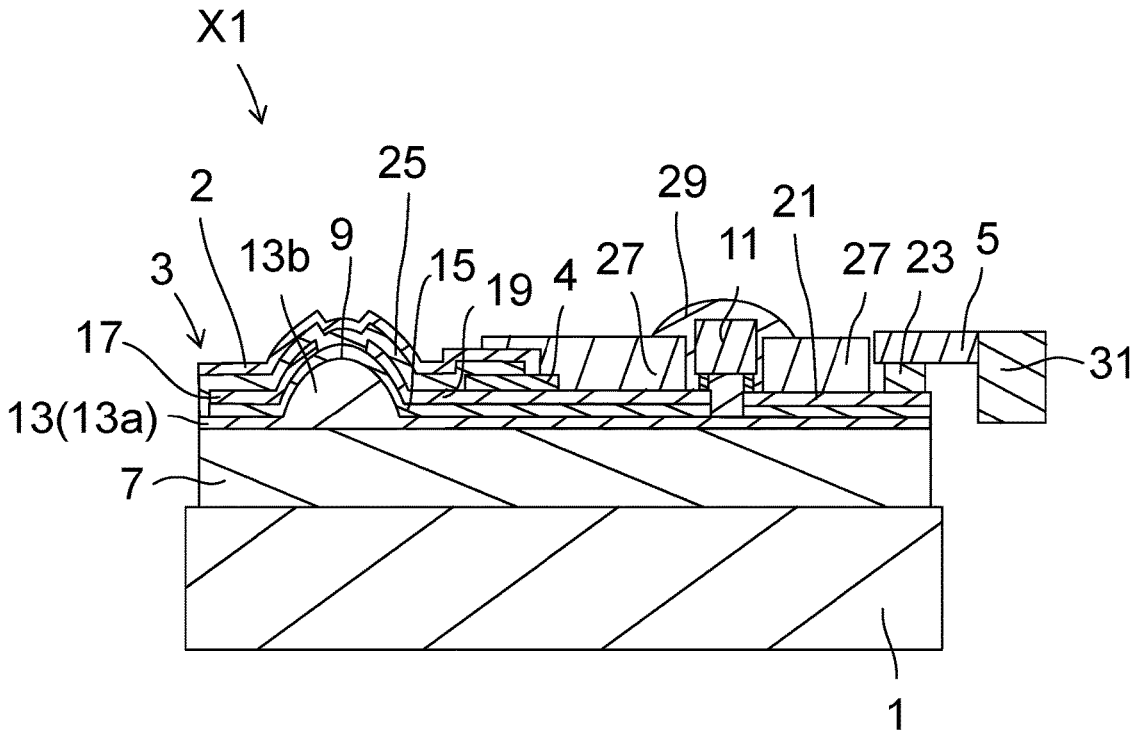
FIG. 2 is a sectional view taken along line II-II of FIG. 1.
Figure 3A:
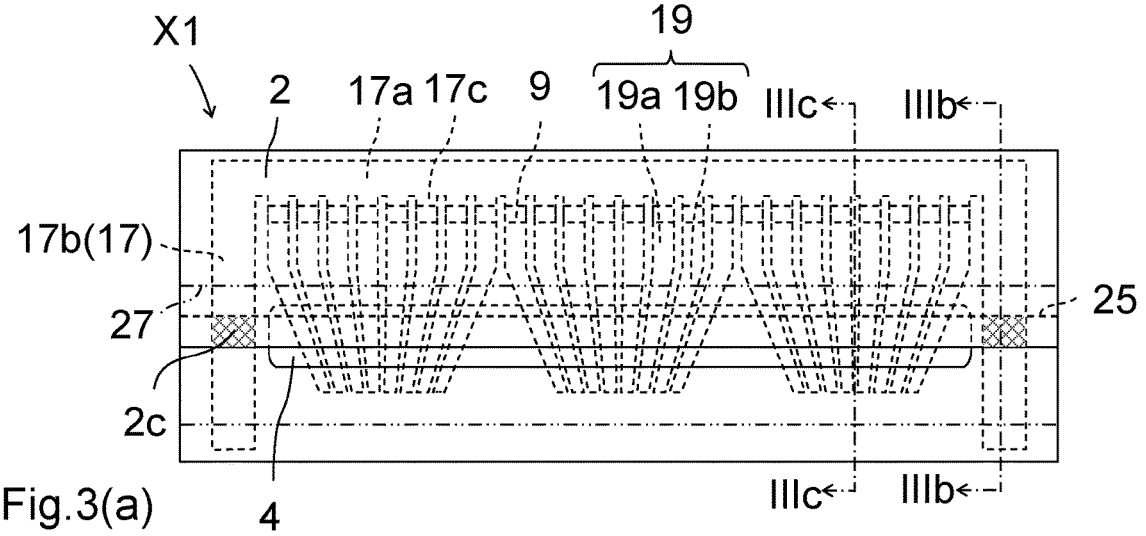
FIG. 3(*a*) is a schematic plan view of the thermal head shown in FIG. 1, FIG. 3(*b*) is a sectional view taken along line IIIb-IIIb of FIG. 3(*a*), and FIG. 3(*c*) is a sectional view taken along line IIIc-IIIc of FIG. 3(*a*).
Figure 3B:
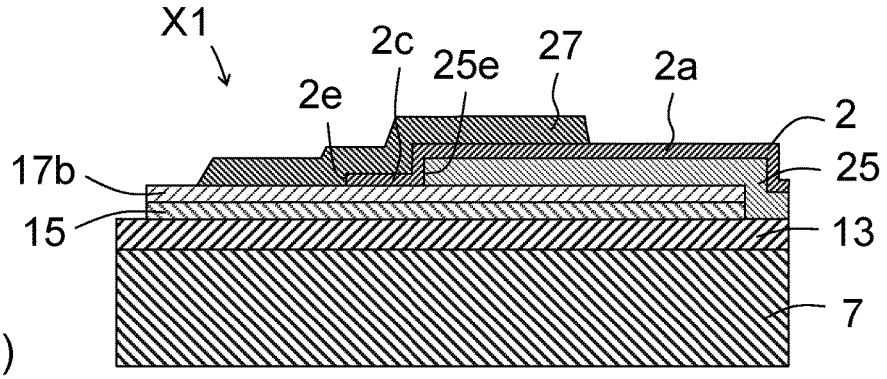
Figure 3C:
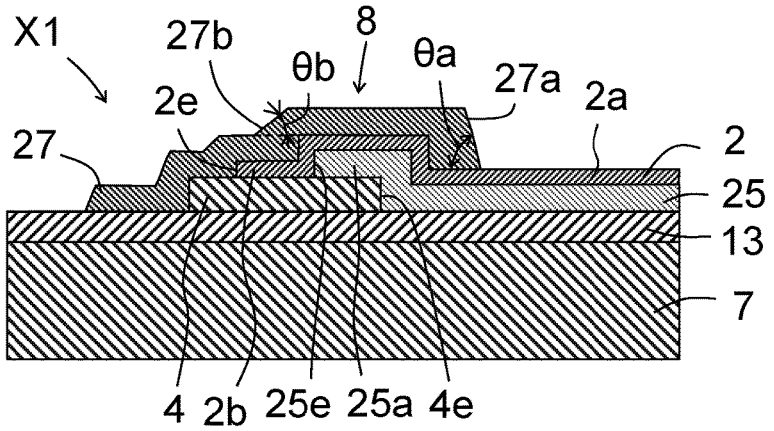

As illustrated in FIGS. 1 and 2, the common electrode 17, the plurality of individual electrodes 19, and the plurality of connection electrodes 21 are disposed on the upper surface of the electrically resistive layer 15. The common electrode 17, the individual electrodes 19, and the connection electrodes 21 are made of an electroconductive material, which is, for example, a metal that is one of aluminum, gold, silver, and copper, or an alloy of such metals.

The common electrode 17 includes a main wiring portion 17*a*, sub-wiring portions 17*b*, and lead portions 17*c*. The main wiring portion 17*a* extends along one long side 7*a* of the substrate 7. The sub-wiring portions 17*b* extend along one short side 7*c* and the other short side 7*d* of the substrate 7. The lead portions 17*c* individually extend from the main wiring portion 17*a* toward the heat generating portions 9. One end of the common electrode 17 is connected to the plurality of heat generating portions 9 and the other end of the common electrode 17 is connected to the FPC 5. Thus, the common electrode 17 electrically connects the FPC 5 and the heat generating portions 9 to each other.

One end of each of the plurality of individual electrodes 19 is connected to a corresponding one of the heat generating portions 9, and the other end of each of the individual electrodes 19 is connected to one of driver ICs 11. Thus, the individual electrodes 19 electrically connect the heat generating portions 9 to the driver ICs 11. The individual electrodes 19 divide the plurality of heat generating portions 9 into a plurality of groups and electrically connect the heat generating portions 9 in each group to one of the driver ICs 11 corresponding to the group.

The individual electrodes 19 each include a linear portion 19*a* and an inclined portion 19*b*. The linear portion 19*a* extends in the sub-scanning direction. The inclined portion 19*b* is inclined with respect to the sub-scanning direction. The linear portion 19*a* electrically connects the inclined portion 19*b* and the heat generating portion 9 to each other. The inclined portion 19*b* electrically connects the linear portion 19*a* and the driver IC 11 to each other.

One end of each of the plurality of connection electrodes 21 is connected to one of the driver ICs 11, and the other end of each of the connection electrodes 21 is connected to the FPC 5. Thus, the connection electrodes 21 electrically connect the driver ICs 11 and the FPC 5 to each other. The plurality of connection electrodes 21 connected to each of the driver ICs 11 includes a plurality of wires having different functions.

As illustrated in FIG. 1, the driver ICs 11 are disposed so as to correspond to each group of the plurality of heat generating portions 9, and are connected to the other end of each of the individual electrodes 19 and the one end of each of the connection electrodes 21. The driver ICs 11 have a function of controlling energization of each of the heat generating portions 9. As each of the driver ICs 11, a switching member including a plurality of switching elements, such as an integrated circuit, may be used.

The electrically resistive layer 15, the common electrode 17, the individual electrodes 19, and the connection electrodes 21 are formed, for example, by stacking material layers for these components successively on the heat storage layer 13 by using a known thin-film forming technique such as sputtering, and then processing the stacked body to have a predetermined pattern by using a known photoetching process or the like. The common electrode 17, the individual electrodes 19, and the connection electrodes 21 can be simultaneously formed by using the same process.

The first insulation layer 25 is disposed on the heat storage layer 13 on the upper surface of the substrate 7. The first insulation layer 25 covers the heat generating portions 9, the common electrode 17, and the individual electrodes 19. To be more specific, the first insulation layer 25 covers the main wiring portion 17*a*, a part of the sub-wiring portions 17*b*, the lead portions 17*c*, the heat generating portions 9, the linear portions 19*a*, and a part of the inclined portions 19*b*. The first insulation layer 25 covers a region extending from an edge of the substrate 7 to a part of the individual electrode 19.

The first insulation layer 25 protects the covered regions of the heat generating portions 9, the common electrode 17, and the individual electrodes 19 from corrosion due to adhesion of water or the like included in the atmosphere or from abrasion due to contact with a recording medium on which printing is to be performed. The first insulation layer 25 can be formed by using SiN, SiO2, SiON, SiC, diamond-like carbon, or the like. The first insulation layer 25 may have a thickness in the range of 3 to 20 μm. The first insulation layer 25 may include a single layer or multiple layers. The first insulation layer 25 can be made by using a thin-film forming technology, such as sputtering. Alternatively, the first insulation layer 25 can be made by using a thick-film forming technology, such as screen printing.

The first insulation layer 25 includes a first overlapping portion 25*a* disposed on a second insulation layer 4. The static removing layer 2 is disposed on the first insulation layer 25, and the static removing layer 2 covers an edge 25*e* of the first insulation layer 25. Thus, the edge 25*e* of the first insulation layer 25 is held between the second insulation layer 4 and the static removing layer 4.

The second insulation layer 4 is disposed adjacent to the first insulation layer 25 and covers the individual electrode 19. To be more specific, the second insulation layer 4 covers a part of the inclined portions 19*b* of the individual electrodes 19 and is disposed nearer than the first insulation layer 25 to the other long side 7*b* of the substrate 7.

The second insulation layer 4 extends in the main scanning direction and is disposed between the sub-wiring portion 17*b* at one end and the sub-wiring portion 17*b* at the other end. That is, the second insulation layer 4 does not cover the sub-wiring portions 17*b* completely. The second insulation layer 4 may cover a part of the sub-wiring portions 17*b*. When stacking the head base body 3 to form the first insulation layer 25, the second insulation layer 4 functions to separate various components of the head base body 3 from another head base body 3 so as to prevent contact between the components and the other head base body 3.

The second insulation layer 4 can be made from a resin material, such as polyimide resin, epoxy resin, or silicone resin by performing printing or application using a dispenser. The second insulation layer 4 may be formed by printing and firing glass.

A part of the first insulation layer 25 is disposed on the second insulation layer 4, and an edge 4*e* of the second insulation layer 4 is covered by the first insulation layer 25. Therefore, the edge 4*e* of the second insulation layer 4 is held between the heat storage layer 13 and the first insulation layer 25. Moreover, the static removing layer 2 is also disposed on the second insulation layer 4. Furthermore, a covering layer 27 is also disposed on the second insulation layer 4. Therefore, the first insulation layer 25, the static removing layer 2, and the covering layer 27 are in contact with the upper surface of the second insulation layer 4.

The static removing layer 2 includes a first portion 2*a*, a second portion 2*b*, and the connection portions 2*c*. The first portion 2*a* is disposed on the first insulation layer 25 and extends in the main scanning direction. The second portion 2*b* is disposed on the second insulation layer 4 and extends in the main scanning direction. The connection portions 2*c* are disposed on the sub-wiring portions 17*b* of the common electrode 17, which are exposed from the first insulation layer 25. Therefore, the static removing layer 2 is electrically connected to the common electrode 17 at the connection portions 2*c*.

The first portion 2*a* is a portion of the static removing layer 2 that is located on the first insulation layer 25. The second portion 2*b* is a portion of the static removing layer 2 that is located on the second insulation layer 4. That is, a portion of the static removing layer 2 that is located on the first overlapping portion 25*a*, which is disposed on the second insulation layer 4, is the first portion 2*a*. The connection portions 2*c* are portions of the static removing layer 2 that are located on the common electrode 17.

The static removing layer 2 has electrical conductivity and has a function of discharging static electricity, which is generated due to conveyance of the recording medium P (see FIG. 7), to the common electrode 17. The static removing layer 2 can be made from, for example, TaSiO or TaN. The static removing layer 2 may have a thickness in the range of 20 to 100 nm. The static removing layer 2 can be formed by using a thin-film forming technology, such as sputtering.

As illustrated in FIG. 3(*c*), the thermal head X1 includes a first stacked portion 8 in which the second insulation layer 4, the first insulation layer 25, and the static removing layer 4 are stacked in this order. The first stacked portion 8 protrudes upward. The first stacked portion 8 is a portion in which the second insulation layer 4, the first insulation layer 25, and the static removing layer 4 are stacked in this order.

The covering layer 27 is disposed on the static removing layer 2. The covering layer 27 is also disposed on the underlying portion 13*a* of the heat storage layer 13, which is disposed on the upper surface of the substrate 7. The covering layer 27 partially covers the common electrode 17, the individual electrodes 19, and the connection electrodes 21. Moreover, the covering layer 27 also covers the first stacked portion 8. A portion of the covering layer 27 that covers the first stacked portion 8 is located at the highest position.

The covering layer 27 protects the covered regions of the common electrode 17, the individual electrodes 19, and the connection electrodes 21 from oxidation due to contact with the atmosphere or from corrosion due to adhesion of water or the like included in the atmosphere. The covering layer 27 is formed so as to overlap a part of the first insulation layer 25 and a part of the static removing layer 2, and seals the common electrode 17 and the individual electrodes 19.

The covering layer 27 is disposed also on the first stacked portion 8 and covers the first stacked portion 8. A side surface 27*a* of the covering layer 27 is inclined toward the first stacked portion 8. A side surface 27*b* of the covering layer 27 is also inclined toward the first stacked portion 8. In a sectional view, the inclination angle θa between the side surface 27*a* of the covering layer 27 closer to the heat generating portions 9 (on the right side in FIG. 3(*c*)) and the substrate 7 is greater than the inclination angle θb between the side surface 27*b* of the covering layer 27 farther from the heat generating portions 9 (on the left side in FIG. 3(*c*)) and the substrate 7.

The side surface 27*a* of the covering layer 27 closer to the heat generating portions 9 is a surface that continuously extends from the upper surface of the covering layer 27 disposed on the first stacked portion 8 to become substantially horizontal with the surface of the substrate 7. The side surface 27*b* of the covering layer 27 farther from the heat generating portions 9 is a surface that continuously extends from the upper surface of the covering layer 27 disposed on the first stacked portion 8 to become substantially horizontal with the surface of the substrate 7.

The inclination angle θa between the side surface 27*a* of the covering layer 27 and the substrate 7 is a smaller one of the angles formed between the side surface 27*a* of the covering layer 27 and the surface of the substrate 7 when the side surface 27*a* is inclined toward the first stacked portion 8. The same applies to the inclination angle θb between the side surface 27*b* of the covering layer 27 and the substrate 7.

The covering layer 27 can be made from a resin material, such as epoxy resin or polyimide resin, by using a thick-film forming technique such as screen printing.

The covering layer 27 has openings (not shown) for exposing the individual electrodes 19 and the connection electrodes 21 connected to the driver ICs 11. These wires are connected to the driver ICs 11 through the openings. In a state in which the driver ICs 11 are connected to the individual electrodes 19 and the connection electrodes 21, the driver ICs 11 are sealed by being covered by covering members 29, which are made of a resin such as epoxy resin or silicone resin, in order to protect the driver ICs 11 and to protect connection portions between the driver ICs 11 and these electrodes.

When the thermal head is driven, static electricity may accumulate on a recording medium due to contact between the first insulation layer and the recording medium. If a recording medium charged with static electricity is conveyed, the static electricity may be discharged to a projection or the like of the head base body, and the thermal head may break.

It may be possible to increase the static removing effect of the thermal head by increasing the area of the first portion on the first insulation layer in a plan view. However, if the first insulation layer has a pin hole, a short circuit between the static removing layer and the individual electrode may occur via the pin hole of the first insulation layer.

In contrast, the static removing layer 2 includes the first portion 2*a*, which is disposed on the upper surface of the first insulation layer 25, and the second portion 2*b*, which is electrically connected to the first portion 2*a* and disposed on the second insulation layer 4. Therefore, the area of the static removing layer 2 in a plan view can be increased. As a result, the static removing layer 4 and the recording medium P are more likely to contact each other, and static electricity accumulated on the recording medium P can be efficiently discharged to the common electrode 17. Therefore, the static removing effect of the thermal head X1 can be increased.

That is, in the thermal head X1, the second insulation layer 4 is disposed adjacent to the first insulation layer 25, and the second portion 2*b* is disposed on the second insulation layer 4. Therefore, the area of the static removing layer 2 in a plan view can be increased by an amount corresponding to the area of the second portion 2*b*. As a result, without increasing the area of the first portion 2*a* in a plan view, it is possible to increase the area of the static removing layer 2 in a plan view and to increase the static removing effect while maintaining insulation between the static removing layer 2 and the individual electrodes 19.

The first insulation layer 25 includes the first overlapping portion 25*a*, which overlaps the second insulation layer 4. Therefore, the edge 4*e* of the second insulation layer 4 is covered by the first insulation layer 25, and the edge 4*e* of the second insulation layer 4 is held between the heat storage layer 13 and the first insulation layer 25. As a result, the edge 4*e* of the second insulation layer 4 is less likely to be peeled off the heat storage layer 13.

Moreover, because the first overlapping portion 25*a* and the second insulation layer 4 are in contact with each other, the adhesion of the first overlapping portion 25*a* can be increased. That is, because the second insulation layer 4 has a surface roughness greater than that of the heat storage layer 13, the adhesion of the first overlapping portion 25*a* disposed on the second insulation layer 4 can be increased. As a result, the adhesion of the first overlapping portion 25*a* can be increased, and peeling from the first overlapping portion 25*a* is less likely to occur.

Preferably, the second insulation layer 4 has a surface roughness in the range of 0.2 to 1 μm. In this case, the first overlapping portion 25*a* enters into small recesses between small protrusions on the surface of the second insulation layer 4. Therefore, the contact area between the first overlapping portion 25*a* and the second insulation layer 4 can be increased. As a result, the adhesion between the first overlapping portion 25*a* and the second insulation layer 4 can be further improved.

When the surface roughness of the second insulation layer 4 is in the aforementioned range, the contact area between the second insulation layer 4 and the static removing layer 2 disposed on the second insulation layer 4 can be increased. Therefore, the adhesion between the second insulation layer 4 and the static removing layer 2 can be also improved.

The surface roughness can be measured by using a contact or non-contact profilometer.

The first portion 2*a* is disposed on the first overlapping portion 25*a*; the second insulation layer 4, the first insulation layer 25, and the static removing layer 4 are stacked in this order in the first stacked portion 8; and the first stacked portion 8 protrudes upward. As a result, the first stacked portion 8 contacts the recording medium P, and thereby the first stacked portion 8 is pressed downward. Therefore, the first stacked portion 8 is less likely to be peeled off the substrate 7.

The first stacked portion 8 and the connection portions 2*c* are located adjacent to each other in the main scanning direction. Since the first stacked portion 8 protrudes upward, the connection portions 2*c* are not likely to contact the recording medium P.

That is, since the first stacked portion 8 and the connection portions 2*c* are located adjacent to each other in the main scanning direction, the first stacked portion 8 and the connection portions 2*c* simultaneously contact the recording medium P. However, since the first stacked portion 8 protrudes upward, the recording medium P contacts the first stacked portion 8 and is not likely to contact the connection portions 2*c*, which have a lower height. As a result, the contact portions 2*c* are less likely to be peeled off the common electrode 17, and deterioration of the static removing function can be suppressed.

The edge 25*e* of the first insulation layer 25 is held between the second insulation layer 4 and the static removing layer 2. Therefore, the edge 25*e* of the first insulation layer 25*a* is less likely to be peeled off the second insulation layer 4. As a result, the sealing ability of the first insulation layer 25 is not likely to decrease, and the thermal head X1 can have improved reliability.

An edge 2*e* of the static removing layer 2 is located on the second insulation layer 4, and the edge 2*e* of the static removing layer 2 is covered by the covering layer 27. Therefore, the edge 2*e* of the static removing layer 2 is held between the second insulation layer 4 and the covering layer 27. As a result, the edge 2*e* of the static removing layer 2 is not likely to be peeled off, and the static removing function is less likely to deteriorate.

The covering layer 27 is disposed on the first stacked portion 8. Therefore, even if a recording medium and the first stacked portion 8 contact each other, the covering layer 27 protects the first stacked portion 8, and the first stacked portion 8 is less likely to brake.

In a sectional view, the inclination angle θa between the side surface 27*a* of the covering layer 27 closer the heat generating portions 9 and the substrate 7 is greater than the inclination angle θb between the side surface 27*b* of the covering layer 27 farther from the heat generating portions 9 and the substrate 7. Therefore, the area of the static removing layer 2 exposed from the covering layer 27 can be increased. That is, as illustrated in FIG. 3(*c*), a length over which the side surface of the covering layer 27 covers the static removing layer 2 can be reduced. Therefore, the exposed area of the static removing layer 2 can be increased.

If the first insulation layer 25 is formed without forming the second insulation layer 4, portions in which sufficient sealiblity cannot be obtained due to steps between various electrodes may appear. In particular, the sealability of the inclined portions 19*b* of the individual electrodes 19, in which the density of wires is high, tends to be low, and therefore the sealability of the first insulation layer 25 is likely to decrease.

In contrast, the second insulation layer 4 is disposed on the inclined portions 19*b*. Therefore, the second insulation layer 4 can ensure the sealability of the inclined portions 19*b*. Thus, the reliability of the thermal head X1 can be improved.

The first insulation layer 25 need not include the first overlapping portion 25*a*. The first stacked portion 8 need not be provided. The edge 25*b* of the first insulation layer 25 need not be held between. The second insulation layer 4 may be disposed only on the linear portion 19*a*.

Figure 4A:
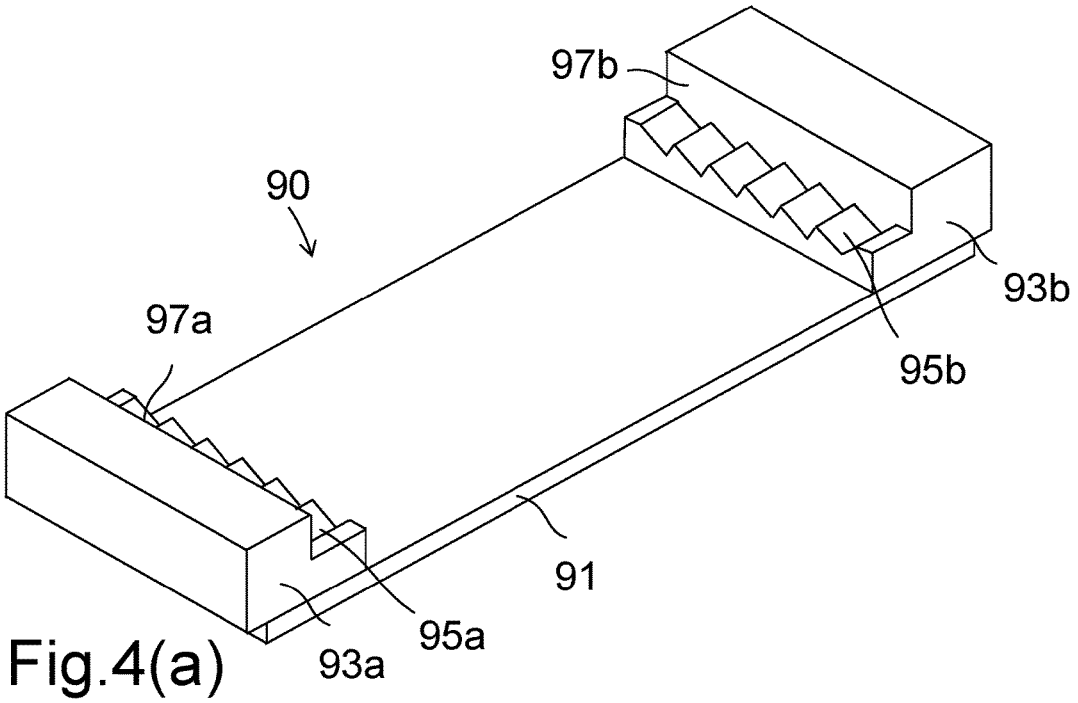
FIG. 4(*a*) is a perspective view of a jig that is used to form a static removing layer, and FIG. 4(*b*) is a plan view of the jig and head base bodies mounted on the jig.
Figure 4B:
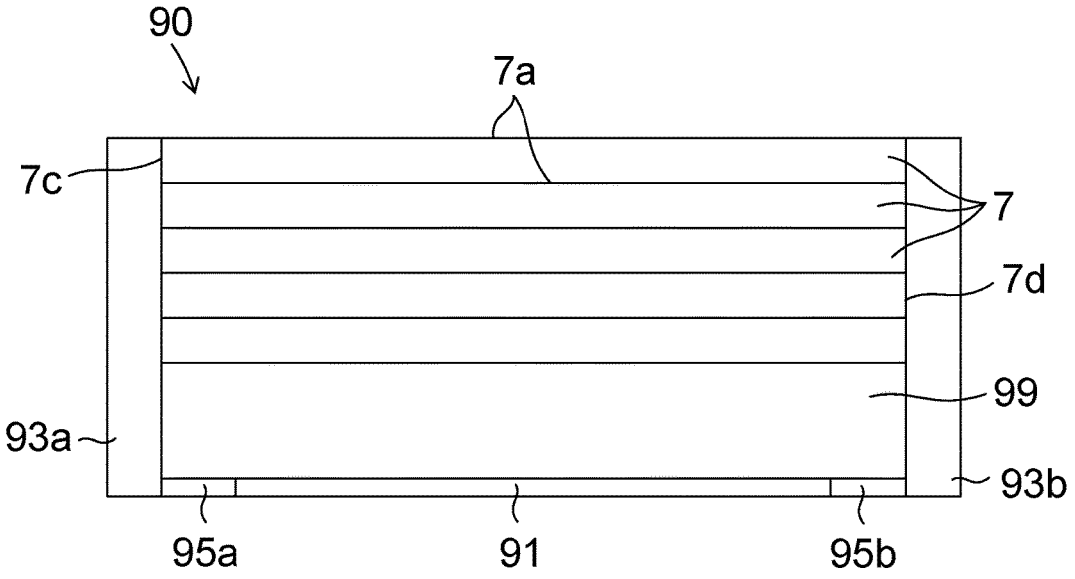

Referring to FIG. 4, a jig 90 that is used to form the first insulation layer 25 and the static removing layer 4 will be described. As illustrated in FIG. 4(*a*), the jig 90 includes a base 91, a first fixing portion 93*a*, and a second fixing portion 93*b*.

The base 91 is elongated in the main scanning direction. The first fixing portion 93*a* is disposed at one end in the main scanning direction, and the second fixing portion 93*b* is disposed at the other end in the main scanning direction. The first fixing portion 93*a* has a first placement surface 95*a*, on which the substrate 7 is to be placed, and a first abutting surface 97*a*, against which the substrate 7 is to be abutted. The second fixing portion 93*b* has a second placement surface 95*b*, on which the substrate 7 is to be placed, and a second abutting surface 97*b*, against which the substrate 7 is to be abutted. The second fixing portion 93*b* is attached to the base 91 in a state in which the second fixing portion 93*b* is variable in the main scanning direction.

The first placement surface 95*a* and the second placement surface 95*b* have steps that correspond to each other so that substrates that are adjacent to each other in a direction perpendicular to the main scanning direction can be stacked on top of each other. As illustrated in FIG. 4(*b*), the substrates 7 are stacked on the first placement surface 95*a* and the second placement surface 95*b* in a state in which one long side 7*a* of each of the substrates 7 protrudes from the first placement surface 95*a* and the second placement surface 95*b*.

The first abutting surface 97*a* and the second abutting surface 97*b* position the substrates 7 when the one short side 7*c* of each of the substrates 7 or the other short side 7*d* of each of the substrates 7 is abutted. Therefore, the first abutting surface 97*a* and the second abutting surface 97*b* are formed on a plane perpendicular to the main scanning direction.

Figure 5A:
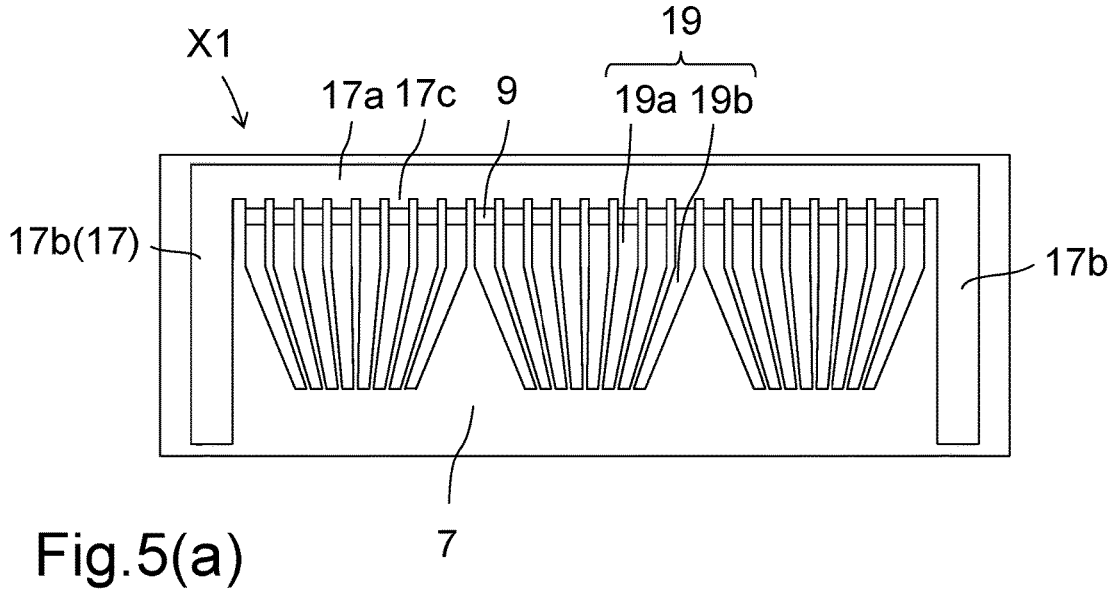
FIG. 5(*a*) is a plan view illustrating a step of manufacturing a thermal head, and FIG. 5(*b*) is a plan view illustrating a step subsequent to the step shown in FIG. 5(*a*).
Figure 5B:
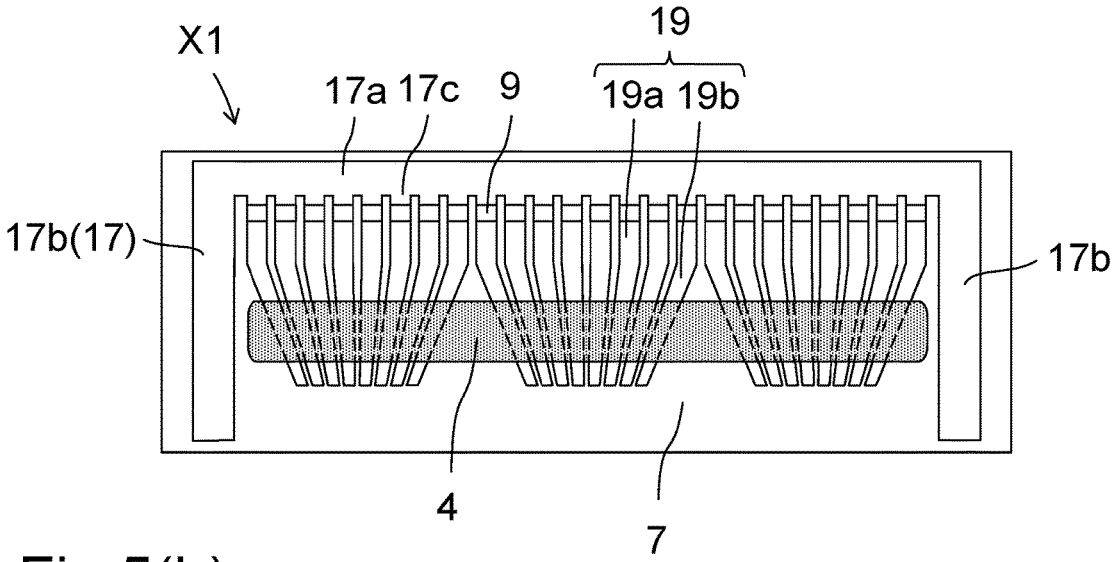
Figure 6A:
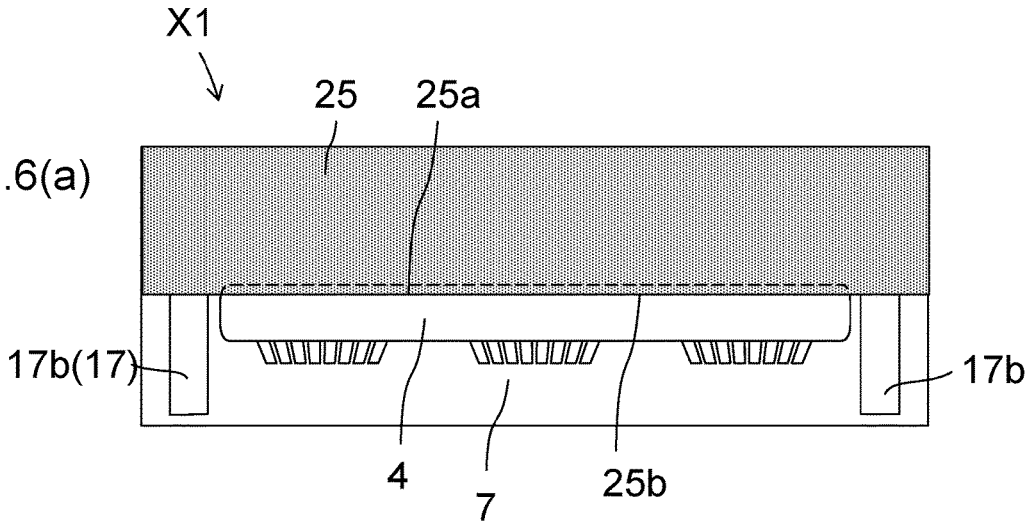
FIG. 6(*a*) is a plan view illustrating a step subsequent to the step shown in FIG. 5(*b*), FIG. 6(*b*) is a plan view illustrating s step subsequent to the step shown in FIG. 6(*a*), and FIG. 6(*c*) is a plan view illustrating a step subsequent to the step shown in FIG. 6(*b*).
Figure 6B:
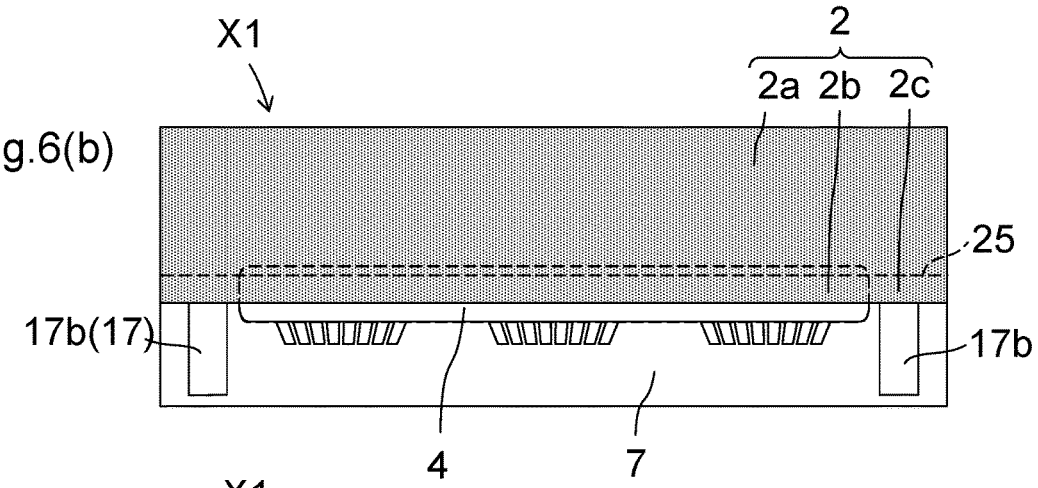
Figure 6C:
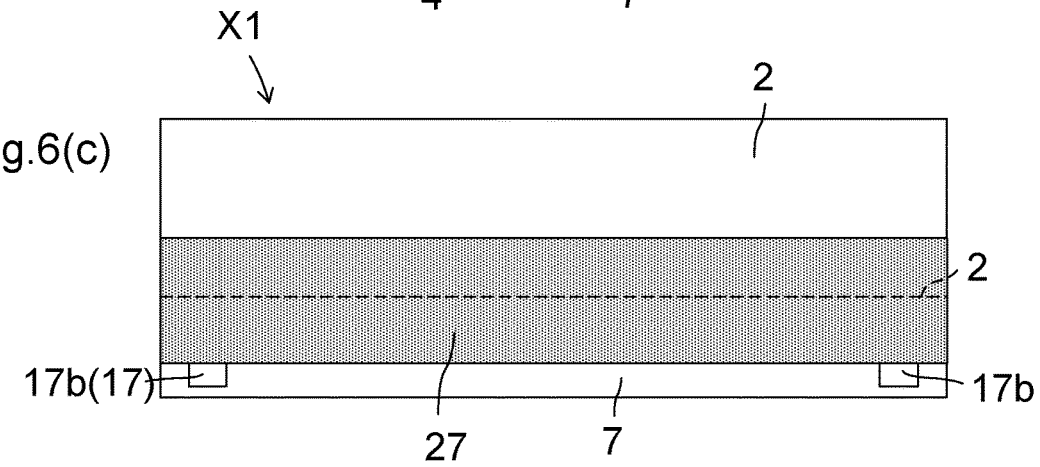

Next, referring to FIGS. 4 to 6, a method of manufacturing the thermal head X1 will be described. In FIGS. 5 and 6, the structures of the common electrode 17 and the individual electrodes 19 are simplified, and the connection electrodes and the like are omitted. Components formed in each step are shown by dotted hatching.

First, as illustrated in FIG. 5(*a*), the common electrode 17, the heat generating portions 9, and the individual electrodes 19 are patterned on the substrate 7.

Next, as illustrated in FIG. 5(*b*), the second insulation layer 4 is formed on the substrate 7, on which the electrodes have been formed, so as to be disposed between the sub-wiring portions 17*b*. The second insulation layer 4 can be formed by using a printing method. The second insulation layer 4 may have a width in the range of 1 to 20 mm and a thickness in the range of 4 to 40 μm.

Next, as illustrated in FIG. 6(*a*), the first insulation layer 25 is formed. The first insulation layer 25 is formed so that a part thereof overlaps the second insulation layer 4, and the overlapping portion is the first overlapping portion 25*a*. The edge 25*e* of the first insulation layer 25 is formed so as to extend in the main scanning direction.

Referring to FIG. 4, formation of the first insulation layer 25 using the jig 90 will be described First, the first one of the substrates 7 is placed on the first step of the first placement surface 95*a* and the second placement surface 95*b*. At this time, the first one of the substrates 7 is placed so that one short side 7*c* thereof abuts against the first abutting surface 97*a*. The other long side (not shown) of the first one of the substrates 7 is abutted against the step. The term "first step" means a step in an upper part of FIG. 4(*b*).

Next, the second one of the substrates 7 is placed on the second step of the first placement surface 95*a* and the second placement surface 95*b*. At this time, the second one of the substrates 7 is placed so that one short side 7*c* thereof abuts against the first abutting surface 97*a*. The other long side (not shown) of the second one of the substrates 7 is abutted against the step, and the second one of the substrates 7 is placed so that the back surface thereof contacts the second insulation layer 4 of the first one of the substrates 7.

Therefore, the second one of the substrates 7 is placed above the first one of the substrates 7 in a state in which the second one of the substrates 7 is separated from the first one of the substrates 7. Moreover, the second one of the substrates 7 is placed so that one long side 7*a* thereof protrudes from the first placement surface 95*a* and the second placement surface 95*b* in a plan view. The distance between the steps of the jig 90 is set so that regions of the substrates 7 that are exposed when the substrates 7 are placed on the jig 90 are regions in which the second insulation layers (not shown) are disposed.

Next, the substrates 7 are successively stacked on the jig 90. Then, a rectangular mask plate 99 is placed on the uppermost step of the first placement surface 95*a* and the second placement surface 95*b*. Next, the second fixing portion 93*b* is moved toward the first fixing portion 93*a*, and the second abutting surfaces 97*b* is abutted against the other short side 7*d* of each of the substrates 7. Finally, the substrates 7 are mounted on the jig 90 by fixing the stacked substrates 7 in place by using a pressing member (not shown). The term "the uppermost step" means a step in a lower part of FIG. 4(*b*).

Then, the jig 90 is placed in a sputtering device. By performing sputtering in a direction perpendicular to the plane of FIG. 4(*b*), the first insulation layer 25 is formed as illustrated in FIG. 6(*a*).

Next, as illustrated in FIG. 6(*b*), the static removing layer 2 is formed. As with the first insulation layer 25, the static removing layer 2 is formed by using the jig 90 for forming the static removing layer 2 shown in FIG. 4. The static removing layer 2 is formed so as to have a length in the sub-scanning direction greater than that of the first insulation layer 25.

As illustrated in FIG. 6, the jig 90 for forming the static removing layer 2 differs from the jig 90 for forming the first insulation layer 25 in the distance between the steps. That is, the distance between the steps of the jig 90 for forming the static removing layer 2 is greater than the distance between the steps of the jig 90 for forming the first insulation layer 25. The substrate 7 is placed so that the back surface thereof contacts the second insulation layer 4. Thus, the area of the static removing layer 2 in a plan view can be made greater than the area of the first insulation layer 25 in a plan view.

As described above, the first insulation layer 25 and the static removing layer 2 can be formed by stacking the plurality of substrates 7 by using the second insulation layer 4 as a common spacer. Therefore, the thermal head X1 can be manufactured efficiently.

That is, the first portion 2*a*, the second portion 2*b*, and the connection portions 2*c* can be easily formed by forming the static removing layer 2, which has a larger area in a plan view than the first insulation layer 25, by stacking the substrates 7 by using the second insulation layer 4 as a spacer. As a result, without using a complex mask, the stacked substrates 7 can be used as a mask, and the thermal head X1 can be manufactured efficiently.

In the thermal head X1, the second insulation layer 4 is disposed between the sub-wiring portions 17*b*. Therefore, the first portion 2*a*, the second portion 2*b*, and the connection portions 2*c* can be simultaneously formed by forming the static removing layer 2 by using the jig 90. That is, the second insulation layer 4 functions as a spacer and a mask. As a result, the thermal head X1 can be manufactured efficiently.

Next, as illustrated in FIG. 6(*c*), the covering member 27 is applied by printing and cured. Thus, the thermal head X1 can be manufactured.

In the example shown above, the first insulation layer 25 and the static removing layer 2 are formed by using the jig 90. However, this is not a limitation. The first insulation layer 25 and the static removing layer 2 may be formed by using a masking tape or a mask member.

Figure 7:
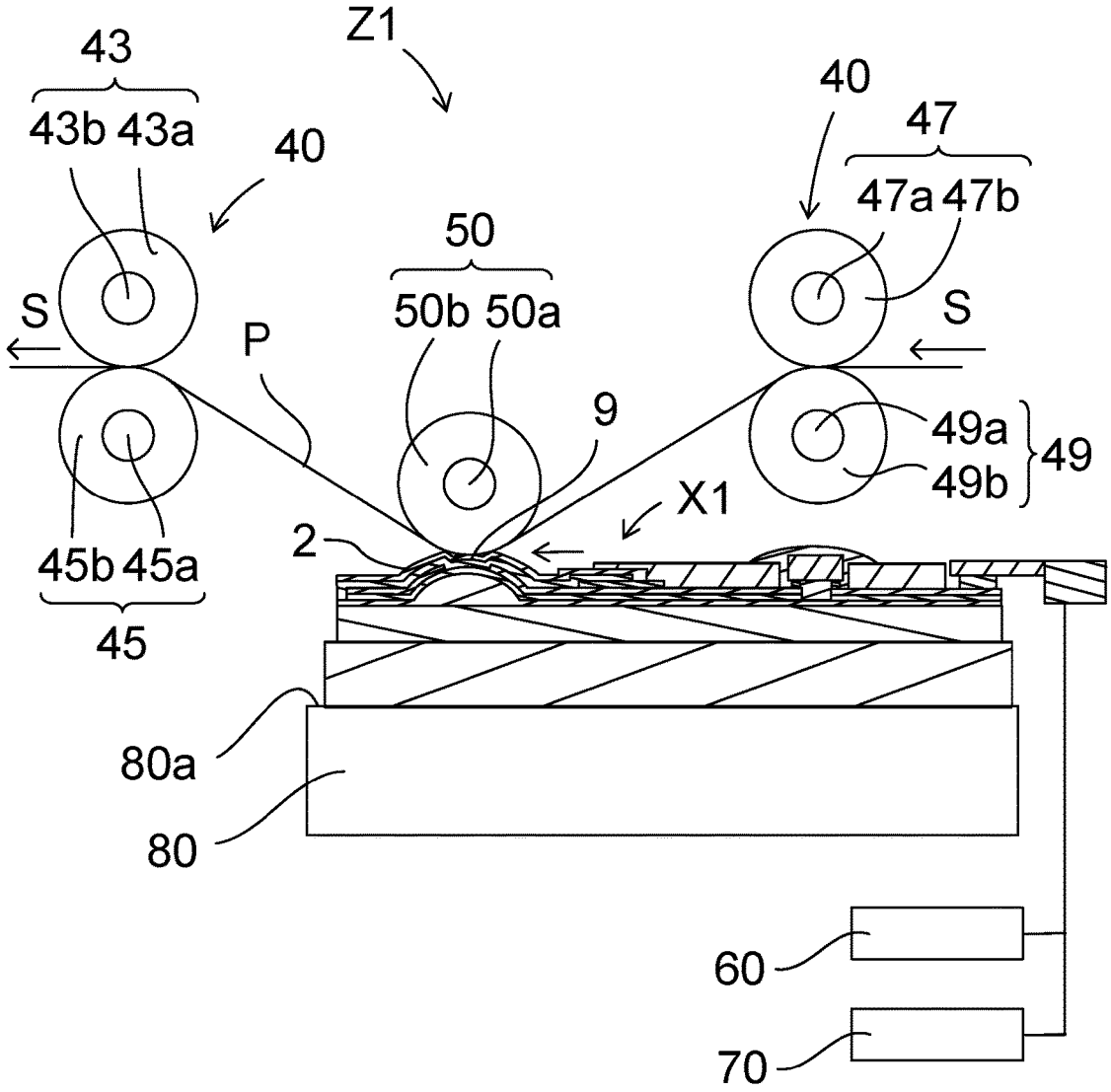
FIG. 7 schematically illustrates the structure of a thermal printer according to the first embodiment of the present invention.

Next, a thermal printer Z1 will be described with reference to FIG. 7.

The thermal printer Z1 according to the present embodiment includes the thermal head X1 described above, a conveying mechanism 40, a platen roller 50, a power supply device 60, and a control device 70. The thermal head X1 is mounted on a mounting surface 80*a* of a mounting member 80 disposed in a housing (not shown) of the thermal printer Z1. The thermal head X1 is attached to the mounting member 80 in such a way that the main scanning direction of the heat generating portions 9 is parallel to the main scanning direction that is perpendicular to the sub-scanning direction S, which is the conveying direction of a recording medium P described below.

The conveying mechanism 40 includes a driving unit (not shown) and conveying rollers 43, 45, 47, and 49. The conveying mechanism 40 conveys a recording medium P, such as heat-sensitive paper or image-receiving paper to which ink is to be transferred, in the direction S illustrated in FIG. 7 onto the first insulation layer 25, which is located on the plurality of heat generating portions 9 of the thermal head X1. The driving unit has a function of driving the conveying rollers 43, 45, 47, and 49. For example, a motor can be used as the driving unit. The conveying rollers 43, 45, 47, and 49 can be formed, for example, by covering cylindrical shafts 43*a*, 45*a*, 47*a*, and 49*a*, which are made of a metal such as stainless steel, with elastic members 43*b*, 45*b*, 47*b*, and 49*b*, which are made of butadiene rubber or the like. Although not illustrated, if the recording medium P is image-receiving paper or the like to which ink is to be transferred, an ink film is conveyed together with the recording medium P to a space between the recording medium P and the heat generating portions 9 of the thermal head X1.

The platen roller 50 has a function of pressing the recording medium P against the protective film 25 located on the heat generating portions 9 of the thermal head X1. The platen roller 50 is disposed so as to extend in a direction perpendicular to the conveying direction S of the recording medium P. Both ends of the platen roller 50 are supported so that the platen roller 50 can rotate while pressing the recording medium P against the heat generating portions 9. The platen roller 50 can be formed, for example, by covering a cylindrical shaft 50*a*, which is made of a metal such as stainless steel, with an elastic member 50*b* made of butadiene rubber or the like.

The power supply device 60 has a function of supplying an electric current for causing the heat generating portions 9 of the thermal head X1 to generate heat and an electric current for operating the driver ICs 11. The control device 70 has a function of supplying a control signal, for controlling the operation of the driver ICs 11, to the driver ICs 11 to selectively cause the heat generating portions 9 of the thermal head X1 to generate heat as described above.

The thermal printer Z1 performs a predetermined printing operation on the recording medium P by selectively causing the heat generating portions 9 to generate heat by using the power supply device 60 and the control device 70 while pressing the recording medium P against the heat generating portions 9 of the thermal head X1 by using the platen roller 50 and conveying the recording medium P onto the heat generating portions 9 by using the conveying mechanism 40. If the recording medium P is image-receiving paper or the like, printing on the recording medium P is performed by thermally transferring ink of an ink film (not shown), which is conveyed together with the recording medium P, to the recording medium P.

Second Embodiment

Figure 8A:
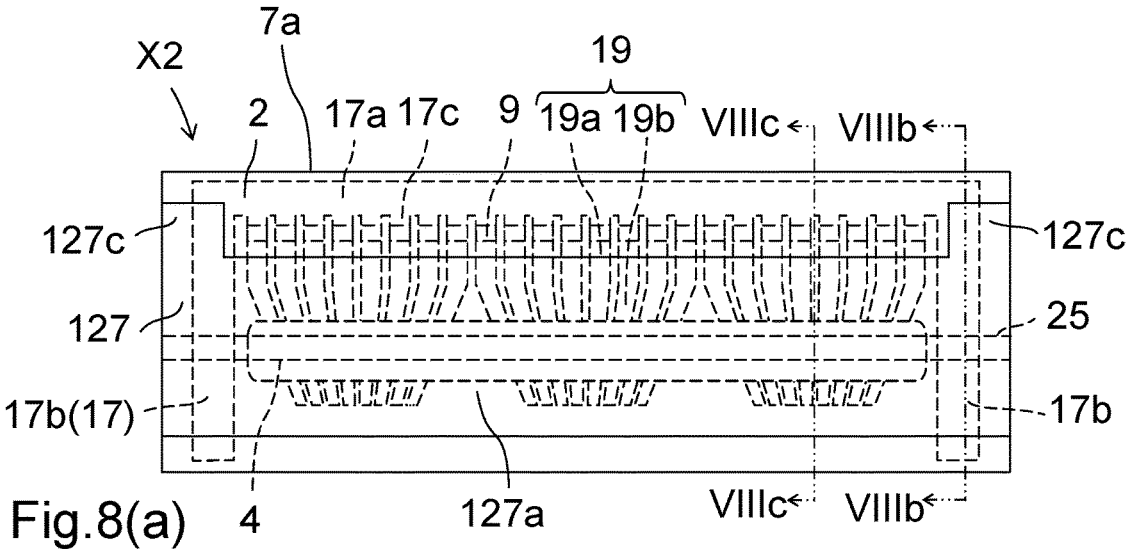
FIGS. 8(*a*) to 8(*c*) illustrate a thermal head according to a second embodiment of the present invention, FIG. 8(*a*) showing a schematic plan view of the thermal head corresponding to FIG. 3(*a*), FIG. 8(*b*) showing a sectional view taken along line VIIIb-VIIIb of FIG. 8(*a*), and FIG. 8(*c*) showing a sectional view taken along line VIIIc-VIIIc of FIG. 8(*a*).
Figure 8B:
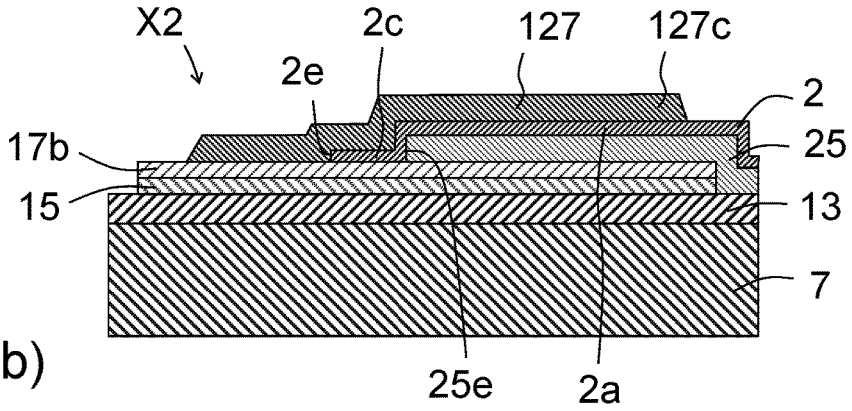
Figure 8C:
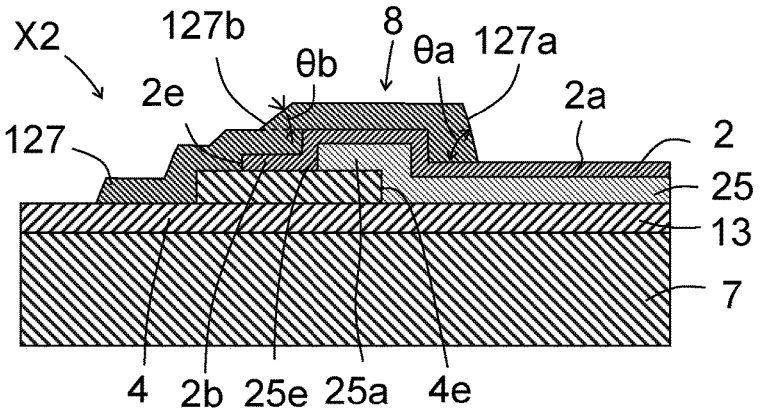

Referring to FIG. 8, a thermal head X2 will be described. The structure of a covering layer 127 of the thermal head X2 differs from that of the covering layer 27 of the thermal head X1. The thermal heads X1 and X2 are the same in other respects, the description of which will be omitted. The same members will be denoted by the same numerals hereafter.

The covering layer 127 includes a base portion 127*a* and a protruding portion 127*c*. The base portion 127*a* has a uniform width and extends in the main scanning direction. The protruding portion 127*c* protrudes from the base portion 127*a* toward one long side 7*a* of the substrate 7. The protruding portion 127*c* protrudes to a position outside of a heat generating region, in which the heat generating portions 9 are arranged in a row, in the main scanning direction.

After the thermal head has been made, lapping of a surface of the static removing layer may be performed to polish the surface. In this case, a pressing force of a lapping film may become high at both end portions in the main scanning direction. Thus, the static removing layer located at both end portions of the main scanning direction may be removed. If this occurs, electrical conduction at both end portions may be inhibited, and the static removing effect may decrease.

In contrast, since the covering layer 127 includes the protruding portion 127*c* while increasing the exposed area of the static removing layer 2 in the conveying region of the recording medium P, the protruding portion 127*c* of the covering layer 127 protects the static removing layer 2 located at both end portions in the main scanning direction, and therefore the connection portions 2*c* of the static removing layer 2 can be protected. As a result, the static removing effect of the static removing layer 2 is less likely to decrease.

Third Embodiment

Figure 9:
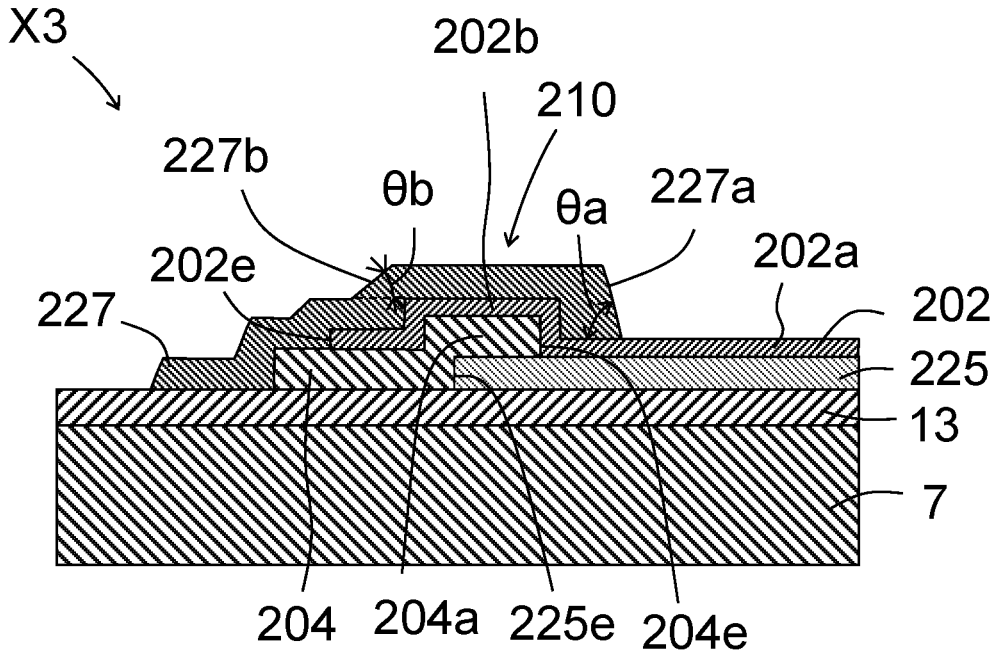
FIG. 9 is a sectional view of a thermal head according to a third embodiment of the present invention corresponding to FIG. 3(*c*).

Referring to FIG. 9, a thermal head X3 according to a third embodiment will be described. FIG. 9 is a sectional view corresponding to FIG. 3(*c*). A sectional view of the thermal head X3 corresponding to FIG. 3(*b*) is omitted. The structures of a first insulation layer 225, a second insulation layer 204, and a static removing layer 202 of the thermal head X3 differ from those of the thermal head X1.

The first insulation layer 225 is disposed on the heat storage layer 13. The second insulation layer 204 is located adjacent to the first insulation layer 225, and a part of the second insulation layer 204 is disposed on the first insulation layer 225. Therefore, the second insulation layer 204 includes a second overlapping portion 204*a* located on the first insulation layer 225.

The static removing layer 204 includes a first portion 202*a*, a second portion 202*b*, and the connection portions 2*c* (see FIG. 3(*a*)). The first portion 202*a* is disposed on the first insulation layer 225, and the second portion 202*b* is disposed on the second insulation layer 204. The second portion 202*b* is disposed on the second overlapping portion 204*a* and forms a second stacked portion 210. The second stacked portion 210 includes the first insulation layer 225, the second overlapping portion 204*a* of the second insulation layer 204, and the second portion 202*b* of the static removing layer 202, which are stacked in this order.

A covering layer 227 covers the second stacked portion 210. The covering layer 227 is disposed on the static removing layer 202, the second insulation layer 204, and the heat storage layer 13 (see FIG. 2), which are located around the second stacked portion 210.

The second insulation layer 204 includes the second overlapping portion 204*a* that overlaps the first insulation layer 225. Therefore, an edge 225*e* of the first insulation layer 225 is covered by the second insulation layer 204, and the edge 225*e* of the first insulation layer 225 is held between the heat storage layer 13 and the second insulation layer 204. As a result, the edge 225*e* of the first insulation layer 225 is less likely to be peeled off the heat storage layer 13.

The second portion 202*b* is disposed on the second overlapping portion 204*a*; the first insulation layer 225, the second insulation layer 204, and the static removing layer 204 are stacked in this order in the second stacked portion 210; and the second stacked portion 210 protrudes upward. As a result, the second stacked portion 210 contacts a recording medium, and thereby the second stacked portion 210 is pressed downward. Therefore, the second stacked portion 210 is less likely to be peeled off the substrate 7.

The second stacked portion 210 and the connection portions 2*c* are located adjacent to each other in the main scanning direction. Therefore, since the second stacked portion 210 protrudes upward, the connection portions 2*c* are not likely to contact a recording medium. As a result, the contact portions 2*c* are less likely to be peeled off the common electrode 17 (see FIG. 3(*a*)), and deterioration of the static removing function can be suppressed.

An edge 204*e* of the second insulation layer 204 is held between the second insulation layer 204 and the static removing layer 202. Therefore, the edge 204*e* of the second insulation layer 204 is less likely to be peeled off the first insulation layer 225. As a result, the sealability of the second insulation layer 204 is not likely to decrease, and the thermal head X1 can have improved reliability.

In a sectional view, the inclination angle θa between a side surface 227*a* of the covering layer 227 closer to the heat generating portions 9 (see FIG. 3(*a*)) and the substrate 7 is greater than the inclination angle θb between a side surface 227*b* of the covering layer 227 farther from the heat generating portions 9 and the substrate 7. Therefore, the area of the static removing layer 202 exposed from the covering layer 227 can be increased. That is, as illustrated in FIG. 9, a length over which the side surface 227*a* of the covering layer 227 covers the static removing layer 2 can be reduced. Therefore, the exposed area of the static removing layer 202 can be increased, and the static removing function can be enhanced.

The present invention is not limited to the embodiments described above, and the embodiments may be modified in various ways within the spirit and scope of the present invention. For example, the thermal printer Z1 described above includes the thermal head X1 according to the first embodiment. However, this is not a limitation. The thermal printer Z1 may include the thermal head X2 or X3. The thermal heads X1 to X3 according to the embodiments may be used in combination.

In the thermal head X1, the heat storage layer 13 includes the protruding portion 13*b*, and the electrically resistive layer 15 is disposed on the protruding portion 13*b*. However, this is not a limitation. For example, without forming the protruding portion 13*b* in the heat storage layer 13, the heat generating portions 9 of the electrically resistive layer 15 may be disposed on the underlying portion 13*a* of the heat storage layer 13. Alternatively, without forming the heat storage layer 13, the electrically resistive layer 15 may be disposed on the substrate 7.

The present invention has been described by using a thin-film head in which the heat generating portions 9 are formed as thin films. Alternatively, the present invention may be applied to a thick-film head in which the heat generating portions 9 are formed as thick films by printing or the like. The present invention may be applied to an end-surface head in which the heat generating portions 9 are formed on an end surface of the substrate 7.

REFERENCE SIGNS LIST

X1 to X3 thermal head
Z1 thermal printer
1 heat sink
2, 202 static removing layer
2*a*, 202*a* first portion
2*b*, 202*b* second portion
2*e*, 202*e* edge
3 head base body
4, 204 second insulation layer
204*a* second overlapping portion
4*e*, 204*e* edge
5 flexible printed circuit (FPC)
7 substrate
8 first stacked portion
9 heat generating portion
11 drive IC
13 heat storage layer
15 electrically resistive layer
17 common electrode
17*a* main wiring portion
17*b* sub-wiring portion
17*c* lead portion
19 individual electrode
19*a* linear portion
19*b* inclined portion
21 connection electrode
23 joining material
25, 125 first insulation layer
25*a*, 125*a* first overlapping portion
25*e*, 125*e* edge
27, 127, 227 covering layer
127*c* protruding portion
29 covering member
90 jig
210 second stacked portion

The invention claimed is:

1. A thermal head comprising:
a substrate;
a plurality of heat generating portions disposed on the substrate;
a common electrode disposed on the substrate and electrically connected to all of the plurality of heat generating portions;
a plurality of individual electrodes disposed on the substrate and each electrically connected to a corresponding one of the plurality of heat generating portions;
a first insulation layer disposed on the heat generating portions, the common electrode, and the individual electrodes;
a second insulation layer located adjacent to the first insulation layer and disposed on the individual electrodes;
a static removing layer that is grounded,
wherein the static removing layer comprises a first portion disposed on the first insulation layer and a second portion electrically connected to the first portion and disposed on the second insulation layer; and
wherein the first insulation layer comprises,
a first overlapping portion that is disposed on the second insulation layer and that overlaps with the second insulation layer in a plan view.

2. The thermal head according to claim 1,
wherein the first portion is disposed on the first overlapping portion,
wherein the thermal head comprises a first stacked portion in which the second insulation layer, the first insulation layer, and the static removing layer are stacked in this order, and
wherein the first stacked portion protrudes upward.

3. The thermal head according to claim 2,
wherein an edge of the first insulation layer is held between the second insulation layer and the static removing layer.

4. The thermal head according to claim 2, further comprising:
a covering layer covering the first stacked portion,
wherein an inclination angle between a side surface of the covering layer closer to the heat generating portions and the substrate is greater than an inclination angle between a side surface of the covering layer farther from the heat generating portions and the substrate in a sectional view.

5. The thermal head according to claim 1,
wherein the second insulation layer comprises an overlapping portion disposed on the first insulation layer.

6. The thermal head according to claim 5,
wherein the second portion is disposed on the overlapping portion,
wherein the thermal head comprises a stacked portion in which the first insulation layer, the second insulation layer, and the static removing layer are stacked in this order, and
wherein the stacked portion protrudes upward.

7. The thermal head according to claim 6,
wherein an edge of the second insulation layer is held between the first insulation layer and the static removing layer.

8. The thermal head according to claim 6, further comprising:
a covering layer covering the second stacked portion,
wherein an inclination angle between a side surface of the covering layer closer to the heat generating portions and the substrate is greater than an inclination angle between a side surface of the covering layer farther from the heat generating portions and the substrate in a sectional view.

9. The thermal head according to claim 1, wherein the common electrode comprises a main wiring portion extending in a main scanning direction, and sub-wiring portions located at both end portions in the main scanning direction and extending in a sub-scanning direction, and wherein the second insulation layer is disposed between the sub-wiring portions.

10. The thermal head according to claim 1, wherein the individual electrodes each include an inclined portion that is inclined with respect to a sub-scanning direction in a plan view, and wherein the second insulation layer is disposed on the inclined portions.

11. A thermal printer comprising:

the thermal head according to claim 1;

a conveying mechanism that conveys a recording medium onto the heat generating portions; and a platen roller that presses the recording medium against the heat generating portions.

12. A thermal head comprising:

a substrate;

a plurality of heat generating portions disposed on the substrate;

a common electrode disposed on the substrate and electrically connected to the plurality of heat generating portions;

a plurality of individual electrodes disposed on the substrate and each electrically connected to a corresponding one of the plurality of heat generating portions;

a first insulation layer disposed on the heat generating portions, the common electrode, and the individual electrodes;

a second insulation layer located adjacent to the first insulation layer and disposed on the individual electrodes;

a static removing layer that is grounded;

a first stacked portion in which the second insulation layer, the first insulation layer, and the static removing layer are stacked in this order; and a covering layer covering the first stacked portion, wherein an inclination angle between a side surface of the covering layer closer to the heat generating portions and the substrate is greater than an inclination angle between a side surface of the covering layer farther from the heat generating portions and the substrate in a sectional view.

13. A thermal printer comprising:

the thermal head according to claim 12;

a conveying mechanism that conveys a recording medium onto the heat generating portions; and a platen roller that presses the recording medium against the heat generating portions.

14. A thermal head comprising:

a substrate;

a plurality of heat generating portions disposed on the substrate;

a common electrode disposed on the substrate and electrically connected to the plurality of heat generating portions;

a plurality of individual electrodes disposed on the substrate and each electrically connected to a corresponding one of the plurality of heat generating portions;

a first insulation layer disposed on the heat generating portions, the common electrode, and the individual electrodes;

a second insulation layer located adjacent to the first insulation layer and disposed on the individual electrodes;

a static removing layer that is grounded;

a stacked portion in which the first insulation layer, the second insulation layer, and the static removing layer are stacked in this order; and a covering layer covering the second stacked portion, wherein an inclination angle between a side surface of the covering layer closer to the heat generating portions and the substrate is greater than an inclination angle between a side surface of the covering layer farther from the heat generating portions and the substrate in a sectional view.

15. A thermal printer comprising:

the thermal head according to claim 14;

a conveying mechanism that conveys a recording medium onto the heat generating portions; and a platen roller that presses the recording medium against the heat generating portions.

* * * * *